US012384592B2

(12) United States Patent
Zoglio

(10) Patent No.: US 12,384,592 B2
(45) Date of Patent: Aug. 12, 2025

(54) PACKAGING DEVICES, METHODS, AND SYSTEMS

(71) Applicant: Fresenius Medical Care Holdings, Inc., Waltham, MA (US)

(72) Inventor: Eric Zoglio, Derry, NH (US)

(73) Assignee: Fresenius Medical Care Holdings, Inc., Waltham, MA (US)

( * ) Notice: Subject to any disclaimer, the term of this patent is extended or adjusted under 35 U.S.C. 154(b) by 55 days.

(21) Appl. No.: 18/229,365

(22) Filed: Aug. 2, 2023

(65) Prior Publication Data

US 2025/0042601 A1 Feb. 6, 2025

(51) Int. Cl.

| | |
|---|---|
| ***B65D 5/32*** | (2006.01) |
| ***B65B 69/00*** | (2006.01) |
| ***B65D 5/50*** | (2006.01) |
| ***B65D 81/02*** | (2006.01) |

(52) U.S. Cl.

CPC ..... *B65D 5/322* (2013.01); *B65B 69/00* (2013.01); *B65D 5/5028* (2013.01); *B65D 65/44* (2013.01)

(58) Field of Classification Search

CPC ..... B65D 5/322; B65D 5/32; B65D 5/5028; B65D 81/02; B65D 65/44

USPC ..... 206/521, 438

See application file for complete search history.

(56) References Cited

U.S. PATENT DOCUMENTS

| | | | | |
|---|---|---|---|---|
| 3,677,201 | A * | 7/1972 | Chadbourne | B65D 19/0012 108/57.33 |
| 4,896,474 | A * | 1/1990 | Osteen | B65B 5/068 53/246 |
| 5,787,817 | A | 8/1998 | Heil | |
| 6,035,790 | A * | 3/2000 | Polando | B65D 19/44 108/55.1 |
| 6,105,511 | A * | 8/2000 | Bridges | B65D 19/0026 312/265.5 |
| 6,126,131 | A | 10/2000 | Tietz | |
| 6,539,881 | B2 * | 4/2003 | Underbrink | B65D 19/44 108/55.3 |
| 10,640,286 | B1 * | 5/2020 | Lycourt | B65B 5/04 |

(Continued)

FOREIGN PATENT DOCUMENTS

| | | | |
|---|---|---|---|
| AU | 2021103420 | A4 | 8/2021 |
| JP | 8143091 | A2 | 11/1994 |

(Continued)

OTHER PUBLICATIONS

International Search Report and Written Opinion for International Application No. PCT/US2024/034290, mailed on Oct. 22, 2024, 14 pages.

*Primary Examiner* — Rafael A Ortiz
(74) *Attorney, Agent, or Firm* — KDW Firm PLLC

(57) ABSTRACT

A packaging system for a medical device includes a box with a base inside the box. The base may include a removable portion, and an adhered portion that is secured to a bottom of the box. The adhered portion may include a wheel guide to align a cabinet onto which an object, such as a medical device, is to be unloaded from the adhered portion of the base. In one example, the packaging system may include a box and a base arranged inside the box. The base may include a removable portion and an adhered portion that is secured to a bottom of the box, the adhered portion comprising a wheel guide to align a cabinet onto which the medical device is unloaded from the adhered portion of the base.

13 Claims, 9 Drawing Sheets

(56) References Cited

U.S. PATENT DOCUMENTS

| | | | | |
|---|---|---|---|---|
| 2003/0102310 | A1* | 6/2003 | Wincent | B65D 9/24<br>220/23.83 |
| 2004/0108238 | A1* | 6/2004 | Maresh | B65D 88/542<br>206/592 |
| 2008/0000397 | A1* | 1/2008 | Dickinson | B65D 19/44<br>108/55.3 |
| 2011/0266177 | A1* | 11/2011 | Lowry | B65D 19/44<br>53/399 |
| 2023/0339648 | A1* | 10/2023 | Morita | B65D 5/5028 |

FOREIGN PATENT DOCUMENTS

| | | | |
|---|---|---|---|
| JP | 3649987 | B2 | 5/2005 |
| JP | 2008103391 | A | 5/2008 |

* cited by examiner

PACKAGING DEVICES, METHODS, AND SYSTEMS

FIELD OF THE DISCLOSURE

The present disclosure relates to packaging for a product, and more particularly to packaging for products that can be bulky and heavy. The packaging embodiments described herein can apply to medical devices, such as dialysis machines, for shipping to a patient.

BACKGROUND

Medical devices are often provided in the patient's home. Examples include home dialysis machines. These types of devices can be large and bulky and may need to be transported to the patient's home via a common carrier such as the USPS®, UPS®, etc. While it is possible to ship a device to the patient's home, it may be difficult for the patient to unpack the device due to the size and weight of the machine. It would be beneficial to provide a system for packaging and shipping the medical devices such that the packaging facilitates easy unpacking and assembly of the medical device(s) received by the patient in a manner that is less physically demanding than conventional packaging methods and materials.

SUMMARY

This Summary is provided to introduce a selection of concepts in a simplified form that is further described below in the Detailed Description. This Summary is not intended to necessarily identify key features or essential features of the claimed subject matter, nor is it intended as an aid in determining the scope of the claimed subject matter.

One general aspect includes a packaging system. The packaging system can be for a medical device. The packaging system includes a box. The packaging system also includes a base that is inside the box. The base may include a removable portion and an adhered portion that is secured to a bottom of the box. The adhered portion may include a wheel guide to align a cabinet onto which the medical device is to be unloaded from the adhered portion of the base.

The adhered portion of the base may further include a center relief through which a strap is passed to align and secure the cabinet with the medical device that is on the adhered portion. The box may include an outer sleeve that is removable. The box further may include an inner sleeve, which may include at least two sidewalls that unfold and flatten to roll the cabinet to be aligned with the adhered portion. The adhered portion may include a friction-reducing surface to slide the medical device onto the cabinet. The removable portion of the base aligns with the wheel guide during the transportation of the medical device. The packaging system may include a second box that holds the cabinet. The box is manufactured using a corrugated material. The base is manufactured using cardboard and polystyrene foam.

Another general aspect includes a method that may include providing a box that may include an object, such as a medical device, resting on a base in the box. The method also includes unfolding a sidewall of the box to create a platform to roll an object with wheels, such as a cabinet with casters, towards the base. The method also includes exposing a wheel guide of the base by separating a removable portion of the base. The method also includes aligning the cabinet with casters with the medical device by rolling the cabinet over the platform and passing a caster of the cabinet into the wheel guide. The method also includes sliding the medical device from the base onto the cabinet with casters.

The medical device may rest on an adhered portion of the base upon separation of the removable portion. A height of the adhered portion is substantially the same as an inner height of the cabinet with casters. A surface of the adhered portion is coated with a friction-reducing agent. The friction-reducing agent may include tape at contact points at which the medical device is in contact with the surface of the adhered portion.

The method further may include, securing the cabinet to the medical device by passing a strap through a center relief of the adhered portion, the strap being engaged with the cabinet and the medical device. Sliding the medical device from the base onto the cabinet with casters may include pulling the cabinet towards the medical device using the strap. Sliding the medical device from the base onto the cabinet with casters may include pushing the medical device onto the cabinet.

The method further may include providing the cabinet with casters as part of a separate box. The box may include an outer sleeve and an inner sleeve, and the unfolding of the sidewall of the box to create the platform may include removing the outer sleeve and unfolding a sidewall of the inner sleeve. The sidewall of the inner sleeve may include a plurality of sidewalls of the inner sleeve.

BRIEF DESCRIPTION OF THE DRAWINGS

By way of example, specific embodiments of the disclosed methods and devices will now be described, with reference to the accompanying drawings, in which:

FIG. 3 illustrates

DETAILED DESCRIPTION

Figure 1:
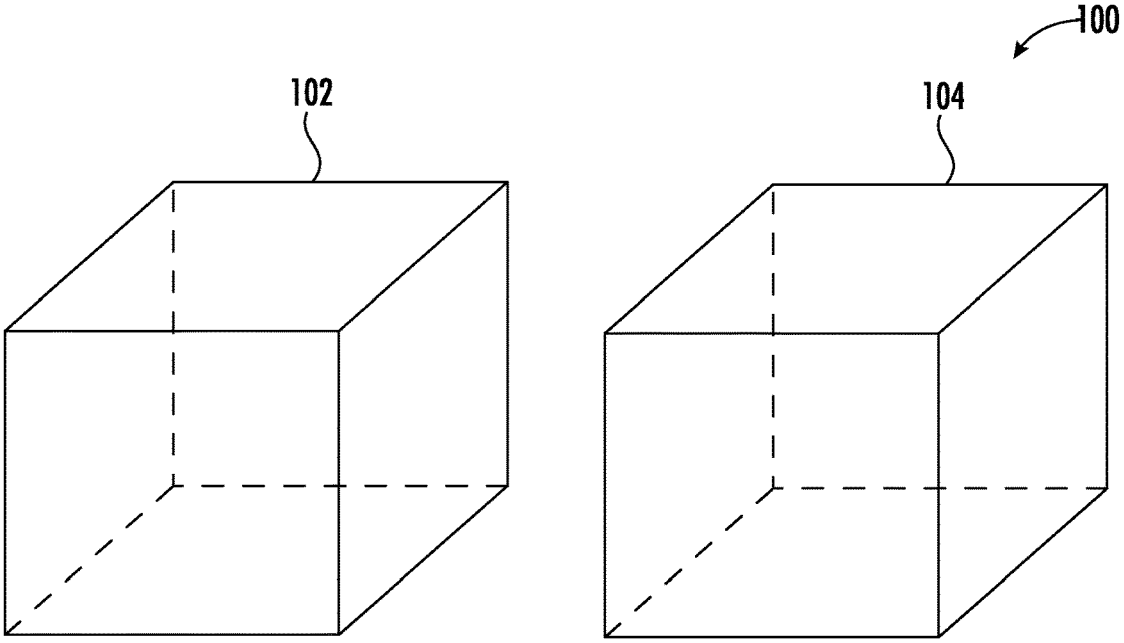
FIG. 1 illustrates features of the subject matter in accordance with one embodiment.

The present embodiments will now be described more fully hereinafter with reference to the accompanying drawings, in which several exemplary embodiments are shown. The subject matter of the present disclosure, however, may be embodied in many different forms and types of devices and systems for dialysis and other potential medical devices and treatments, and should not be construed as limited to the embodiments set forth herein. Rather, these embodiments are provided so that this disclosure will be thorough and complete, and willfully convey the scope of the subject matter to those skilled in the art. In the drawings, like numbers refer to like elements throughout.

FIG. 1 illustrates a packaging system 100 according to one or more embodiments. The packaging system 100 may be for any product, such as a medical device. Packaging system 100 includes at least a cabinet box 102 and a device box 104.

Figure 2:
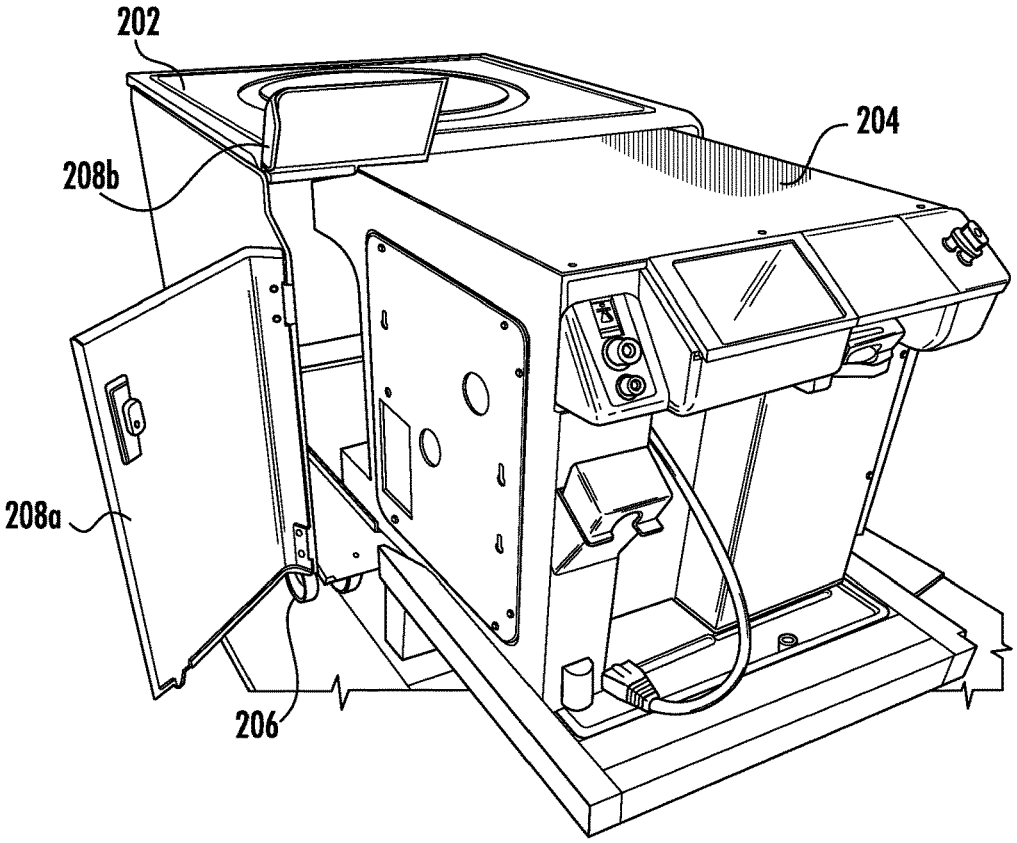
FIG. 2 illustrates features of the subject matter in accordance with one embodiment.

FIG. 2 illustrates at least partial contents of the packaging system 100 according to one or more embodiments. The contents can include a cabinet 202 and a machine 204.

Cabinet 202 may include two or more casters 206 (wheels) that facilitate rolling the cabinet 202. In some embodiments, the cabinet 202 includes one or more protective panels (e.g., panels 208*a* and 208*b*). The panels can include doors to enclose the machine 204 and/or to protect one or more components of the machine 204.

The machine 204 can be a medical device, such as a dialysis machine or any other bulky and significantly heavy product. The machine 204 can be difficult for a typical recipient to lift, maneuver, etc. In some examples, the machine 204 cannot be practically lifted and/or carried by a typical recipient, such as a patient using the machine 204. For instance, the machine 204 can be a dialysis machine with a water purification and proportioning module weighing over 90 pounds, which is intended to be housed in a corresponding cabinet (202).

The cabinet 202 and the machine 204 are provided to the patient's home (or other location of use). The cabinet 202 and machine 204 may be transported via a common carrier, such as USPS®, UPS®, FEDEX®, etc. While it is possible to ship the machine 204 to the patient's home, it is difficult (or even not possible) for the patient to unpack the machine 204 due to the size and weight of the machine 204. Embodiments described herein address such technical problems. Embodiments described herein provide a packaging system 100 that holds a machine 204, such as a home dialysis machine or a component thereof, in a way that makes it easy to install the machine 204 in the cabinet 202, even for a user of limited physical strength.

Referring to FIGS. 1 and 2, in the packaging system 100, the cabinet box 102 is used for packaging and transporting the cabinet 202. The device box 104 is used for packaging and transporting the machine 204, such as a medical device. The cabinet box 102 and the device box 104 may be made of cardboard and/or other packaging material. "Cardboard" can refer to any heavy paper-based products or suitable packaging material. The construction material used for the cabinet box 102 and the device box 104 (collectively referred to as boxes, henceforth) can range from a paper known as paperboard to corrugated fiberboard, which is made of multiple plies of material. The construction material can be corrugated material that is wood based. In other embodiments, the boxes can be made using corrugated plastic or any other multi-use packaging material. Unless expressly specified, the material used to construct the boxes does not limit the technical features provided by embodiments described herein.

It is understood that the illustrations of the cabinet 202, the machine 204, the cabinet box 102, and the device box 104 are examples and that in various embodiments, the shape, dimensions, types, etc., of these components will vary.

Figure 3A:
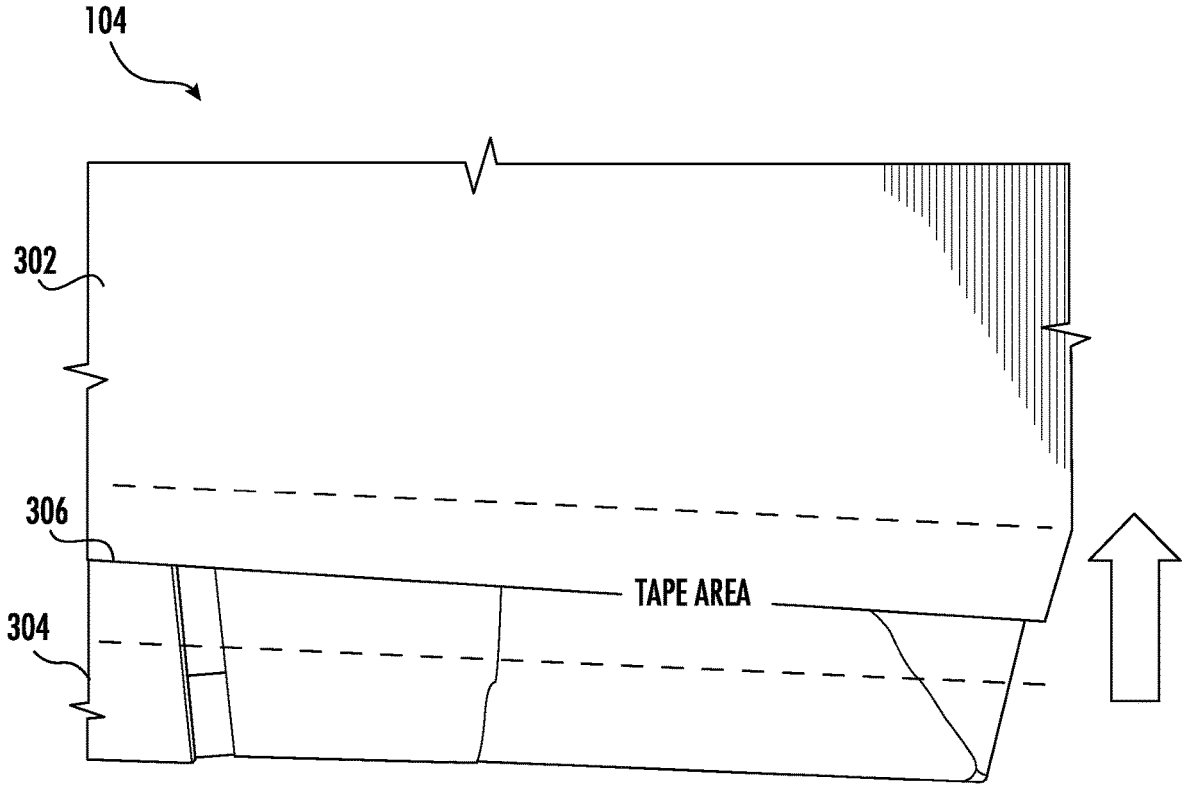
FIGS. 3A and 3B illustrate features of the subject matter in accordance with one embodiment.
Figure 3B:
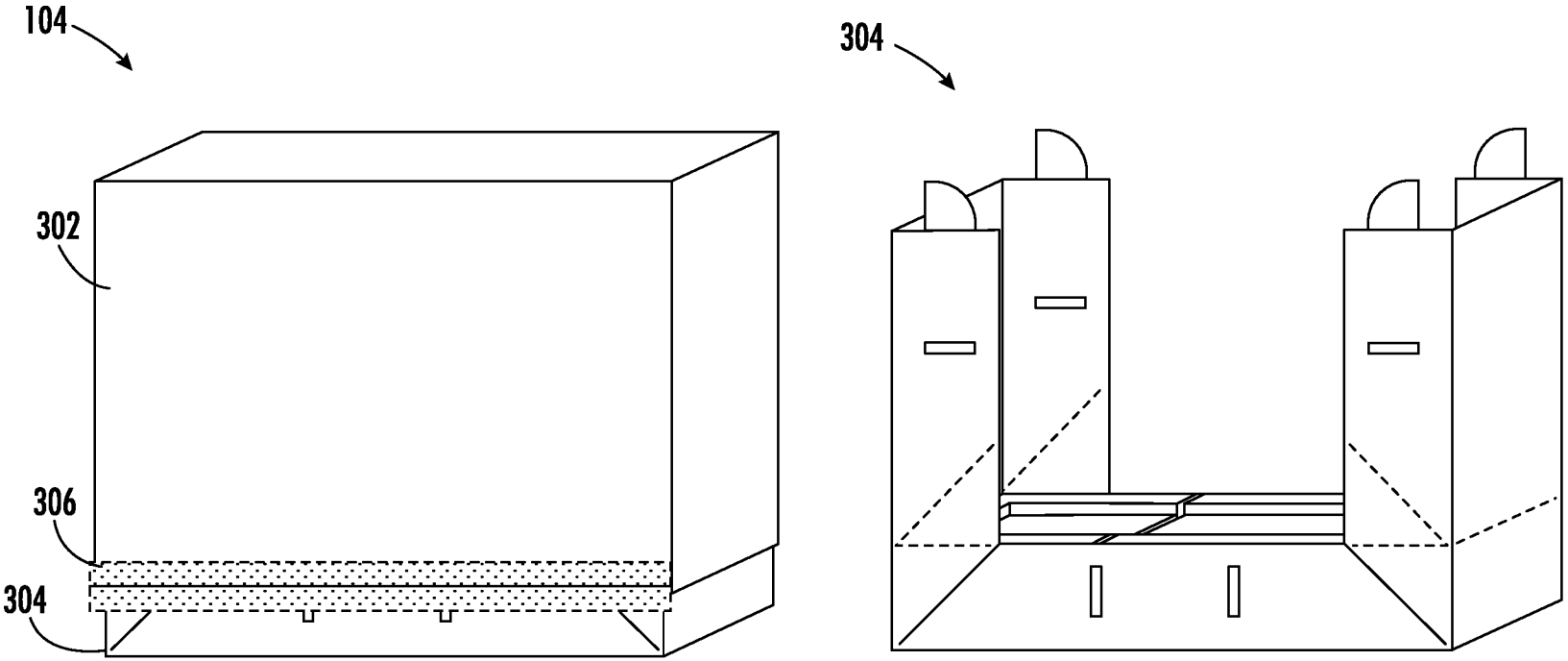

FIG. 3A and FIG. 3B depict the device box 104 according to one or more embodiments. The device box 104 includes an outer sleeve 302 and an inner sleeve 304. The outer sleeve 302 and the inner sleeve 304 are also types of boxes. The inner sleeve 304 contains the machine 204 being transported to the patient, and the outer sleeve 302 contains the inner sleeve 304.

In some embodiments, the outer sleeve 302 is a five-sided box that covers the top and the four sides of the inner sleeve 304. The outer sleeve 302 extends down to the bottom of the inner sleeve 304, however, stops short of the bottom of the inner sleeve by a predetermined distance (for example, about 1 inch, about 2 inches, about 5 inches, about 10 inches, about 12 inches, about 18 inches, etc., and any value or range between any two of these values (including endpoints)). The outer sleeve 302 is secured to the inner sleeve 304 using an adhesive, such as tape, glue, etc., along a predetermined area 306. Alternatively, or in addition, the outer sleeve is secured to the inner sleeve 304 using one or more clamps, screws, nails, staples, pins, or any other type of fasteners along the predetermined area 306. When the device box 104 is delivered, the outer sleeve 302 is separated from the inner sleeve 304. For example, a tape that secures the outer sleeve 302 and the inner sleeve 304 is cut along the area 306, and the outer sleeve 302 is slipped off (see FIG. 3B). Once the outer sleeve 304 is separated, the sides of the inner sleeve 304 are foldable down (or unfolded) to the ground level (see FIG. 5A).

While in the depicted illustration, the outer sleeve 302 is shown to slide over the inner sleeve 304 in a vertical direction (depicted by arrows), in other embodiments, the outer sleeve 302 can be separated from the inner sleeve 304 in several different ways. For example, the outer sleeve 302 may be slid in a horizontal direction, a diagonal direction, etc. Alternatively, or in addition, the outer sleeve 302 may be unfolded to reveal and separate from the inner sleeve 304. How the outer sleeve 302 and the inner sleeve 304 are separated from each other does not limit aspects of the embodiments described herein unless expressly specified.

In one or more embodiments, the outer sleeve 302 and the inner sleeve 304 are made of the same material, such as cardboard. In other embodiments, the outer sleeve 302 and the inner sleeve 304 may be made using different materials. For example, the outer sleeve 302 may be made of sturdier and more protective material compared to the inner sleeve 304. Alternatively, or in addition, the inner sleeve 304 may be made of softer and abrasion-free material to prevent the contents of the device box 104 from being scratched or damaged in any manner.

In some embodiments, the inner sleeve 304 is filled with packaging material, such as packing peanuts, bubble wrap, paper, etc., or any other material that prevents contents from moving and/or being damaged during transit. The inner sleeve 304 may be fastened to the outer sleeve 302, for example, using tape, or any other type of fastener, to protect the contents further. While not shown, the device box 104 can include several other components, such as a corrugated tray, corrugated corner pads, etc., to protect the contents.

Figure 4A:
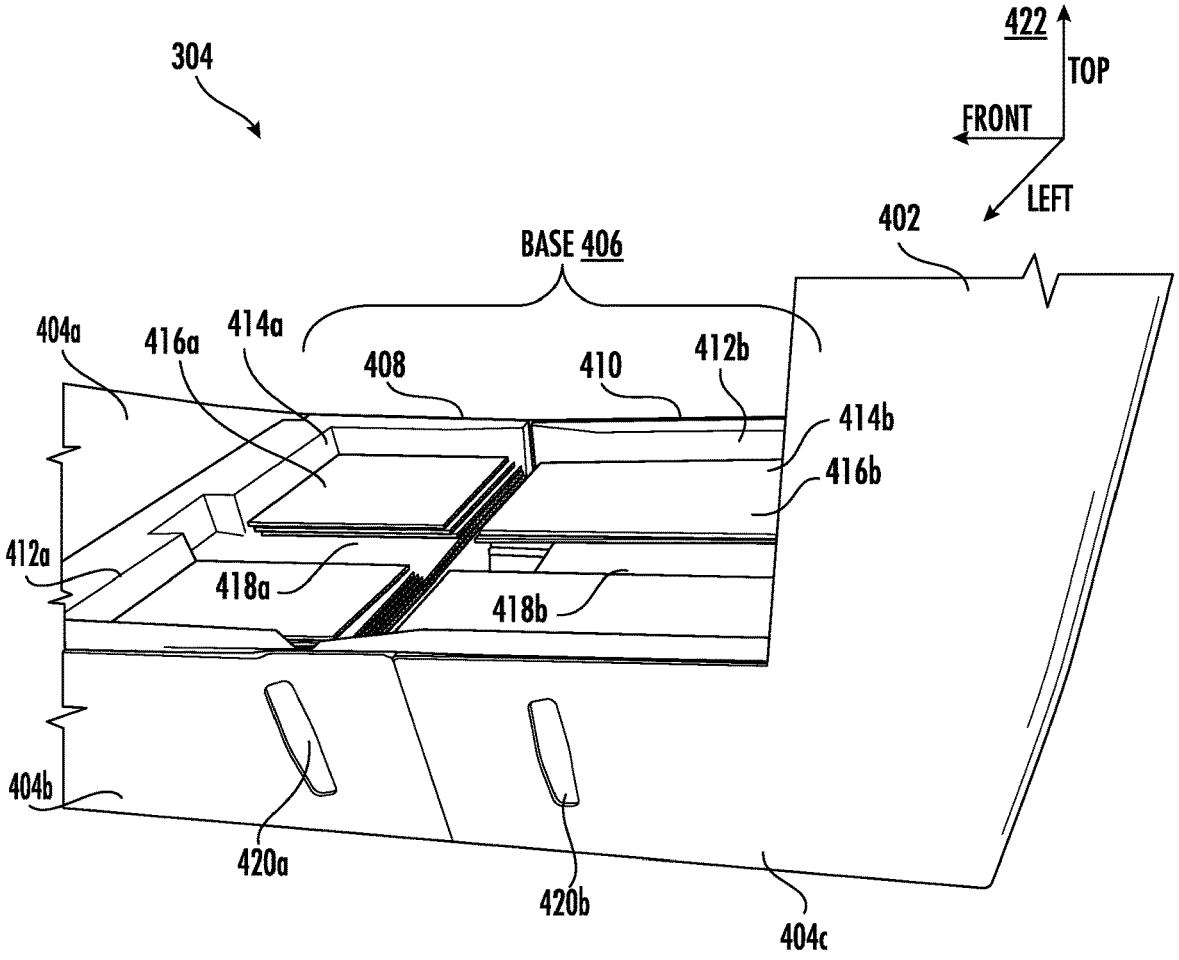
FIG. 4A illustrates features of the subject matter in accordance with one embodiment.
Figure 4B:
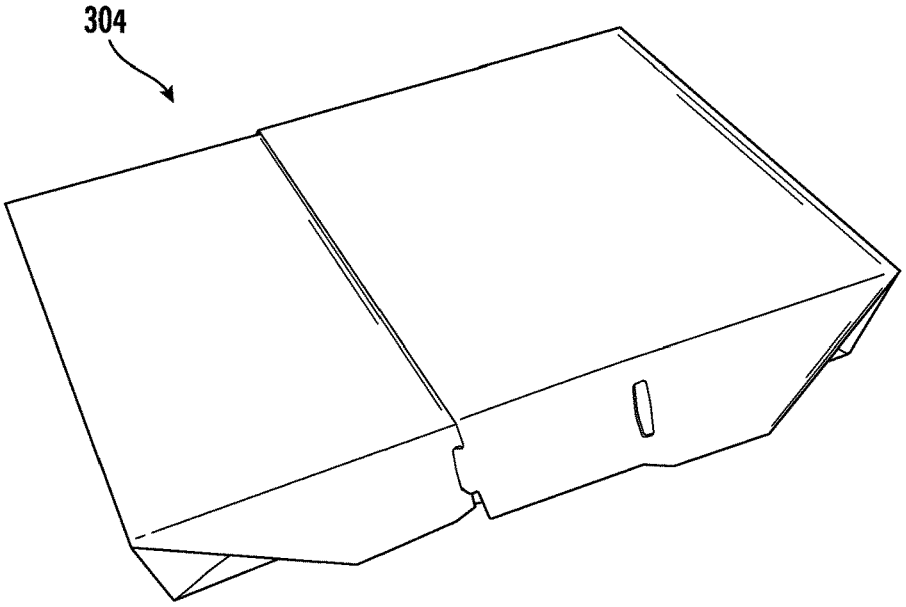
FIG. 4B illustrates features of the subject matter in accordance with one embodiment.
Figure 5A:
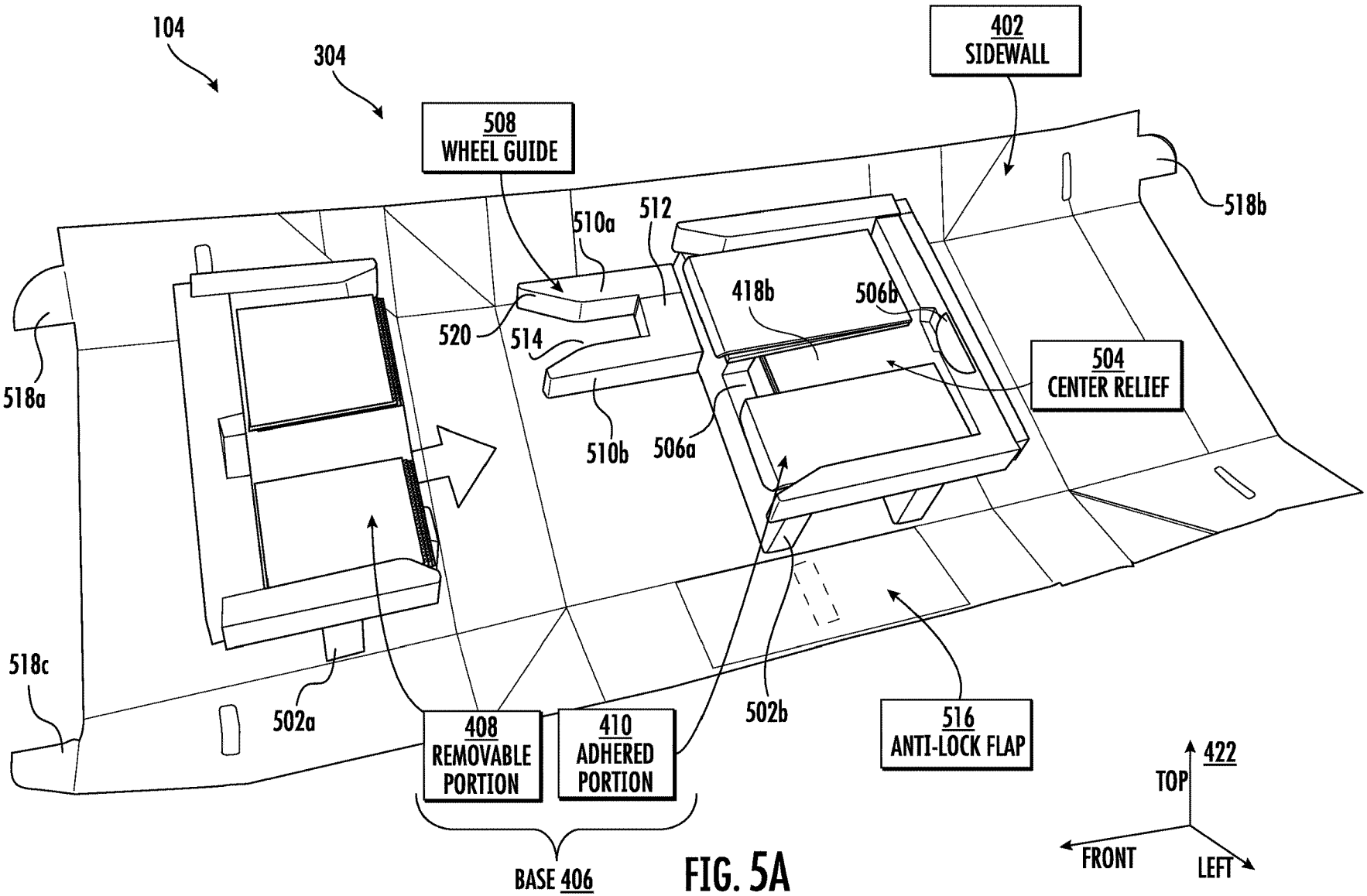
FIG. 5A illustrates features of the subject matter in accordance with one embodiment.

FIG. 4A depicts a view of the inner sleeve according to one or more embodiments. The inner sleeve 304 is a box that includes sidewall 402, sidewall 404*a*, sidewall 404*b*, sidewall 404*c*, and a bottom (not shown). The sidewalls 402 and 404*a* are foldable to cover the front and back sides of the machine 204 placed inside the inner sleeve 304. The sidewall 404*b* and 404*c* are foldable to partially wrap the left and right sides of the machine 204 positioned inside the inner sleeve 304. It should be noted that although not shown in FIG. 4A, the sidewalls 404*b* and 404*c* have counterparts on the opposite side of the inner sleeve 304 that are not visible in FIG. 4A. In some embodiments, the sidewall 402 and the sidewall 404*a* are folded over the sidewalls 404*b* and 404*c*. The sidewalls provide the structure of the inner sleeve 304 when the sidewalls are in a "folded" state. When the sidewalls are in an "unfolded" state, the inner sleeve 304 can be flattened, for example, for storage. In FIG. 4A, the inner sleeve 304 is shown in transition between the folded and the unfolded states; FIG. 4B depicts a folded state of the inner sleeve 304; and FIG. 5A depicts the unfolded state.

In some embodiments, the inner sleeve 304 has different folded states. For example, a first folded state corresponds to a shipping configuration, with the side walls folded into a vertical orientation between the sides of the medical device and the outer sleeve 302. FIGS. 3B and 4A depict such a first folded state. The first folded state facilitates supporting the medical device during the shipping process as described herein. Additionally, the inner sleeve 304 has a second folded state that corresponds to a storage configuration, with the side walls folded into a horizontal orientation. The second state may be achieved after the medical device has been removed from the inner sleeve 304. FIG. 4B depicts an example of the second state. The second state facilitates storage of the inner sleeve 304 for the recipient to store the box system after installing the medical device into the cabinet until/if the medical device is to be removed from the cabinet. The recipient may follow a reverse-order process of installing the medical device as described herein, to load the medical device back into the box system. In the second folded state, the sidewalls (402) of the inner sleeve 304 are folded towards the inside of the inner sleeve 304. In some embodiments, a sidewall is folded to coincide with an edge of the bottom surface, where the edge is orthogonal to the sidewall. In other embodiments, the sidewalls are folded towards the center of the bottom surface. Several other folded states may be possible in other embodiments.

The terms to depict directionality, such as "top," "left," "front," etc., are based on the direction map 422 shown. It is understood that such terms can be used differently based on how the direction map 422 is configured and that such terms are not to be interpreted to limit the features of the embodiments described herein.

Further, the inner sleeve 304 includes a base 406 that is inside the sidewalls and at the bottom of the inner sleeve 304. The base 406 includes a removable portion 408 and an adhered portion 410.

The removable portion 408 can be separated from the inner sleeve 304. The removable portion 408 includes a boundary 412*a* made of a cushioning material, such as extruded foam, polystyrene foam, air pillows, thermoform, paper, or other cushioning material. In some embodiments, the boundary 412*a* is a singular piece of cushioning material with cavity 414*a* in which a device scaffold 416*a* is placed.

The device scaffold 416*a* is made of cardboard and/or any other material that can support the weight of the machine 204. The device scaffold 416*a* is precision cut to the size of the cavity 414*a*, such that the boundary 412*a* surrounds the device scaffold 416*a* on four sides: left, right, front, and bottom. The top and back sides of the device scaffold 416*a* are not covered by the boundary 412*a*. In some embodiments, the boundary 412*a* covers the bottom side of the device scaffold 416*a* only partially. For example, the boundary 412*a*, at the bottom, includes one or more legs 502*a* to hold the device scaffold 416*a* above the ground surface at a predetermined height. In some embodiments, the predetermined height is based on the dimensions of the cabinet 202, for example, a height of an inner (lower) floor of the cabinet 202.

The device scaffold 416*a* includes a channel 418*a* that runs from front to back along the center of the device scaffold 416*a*. The channel 418*a* can be formed by placing at least two pieces of cardboard (or any other material) at a certain distance (channel-width) from each other. Alternatively, the channel 418*a* is formed by carving a single piece of cardboard (or any other material).

The adhered portion 410 is secured to the inner sleeve 304 at the bottom of the inner sleeve 304. For example, the adhered portion 410 is secured to the bottom using fastening material, such as glue, tape, fasteners, or any other suitable technique. The adhered portion 410 includes a boundary 412*b* that is made of a cushioning material, such as extruded foam, polystyrene foam, air pillows, thermoform, paper, or other cushioning material. In some embodiments, the boundary 412*b* is a singular piece of cushioning material that has a cavity 414*b* in which a device scaffold 416*b* is placed.

The device scaffold 416*b* is made of cardboard or any other material that can support the weight of the machine 204. The device scaffold 416*b* is precision cut to the size of the cavity 414*b*, such that the boundary 412*b* surrounds the device scaffold 416*b* on four sides: left, right, back, and bottom. The top and front sides of the device scaffold 416*b* are not covered by the boundary 412*b*. In some embodiments, the boundary 412*b* covers the bottom side of the device scaffold 416*b* only partially. For example, the boundary 412*b*, at the bottom, includes one or more legs 502*b* to hold the device scaffold 416*b* above the ground surface at a predetermined height. In some embodiments, the predetermined height is based on the dimensions of the cabinet 202.

In some embodiments, the height of the adhered portion 410 (including the boundary 412*b* (based on the legs 502*b*) and the device scaffold 416*b*) is a predetermined threshold more than the height of a base of the cabinet 202. Accordingly, the cabinet 202 can be aligned with the adhered portion 410 with the opening of the cabinet 202 facing the machine 204 resting on the adhered portion 410, such that a lower lip of the opening of the cabinet 202 rests under the machine 204. The machine 204 can then be slid into the opening of the cabinet 202.

The device scaffold 416*b* includes a channel 418*b* that runs from front to back along the center of the device scaffold 416*b*. The channel 418*b* can be formed by placing at least two pieces of cardboard (or any other material) at a certain distance (channel-width) from each other. Alternatively, the channel 418*b* is formed by carving a single piece of cardboard (or any other material).

Figure 5B:
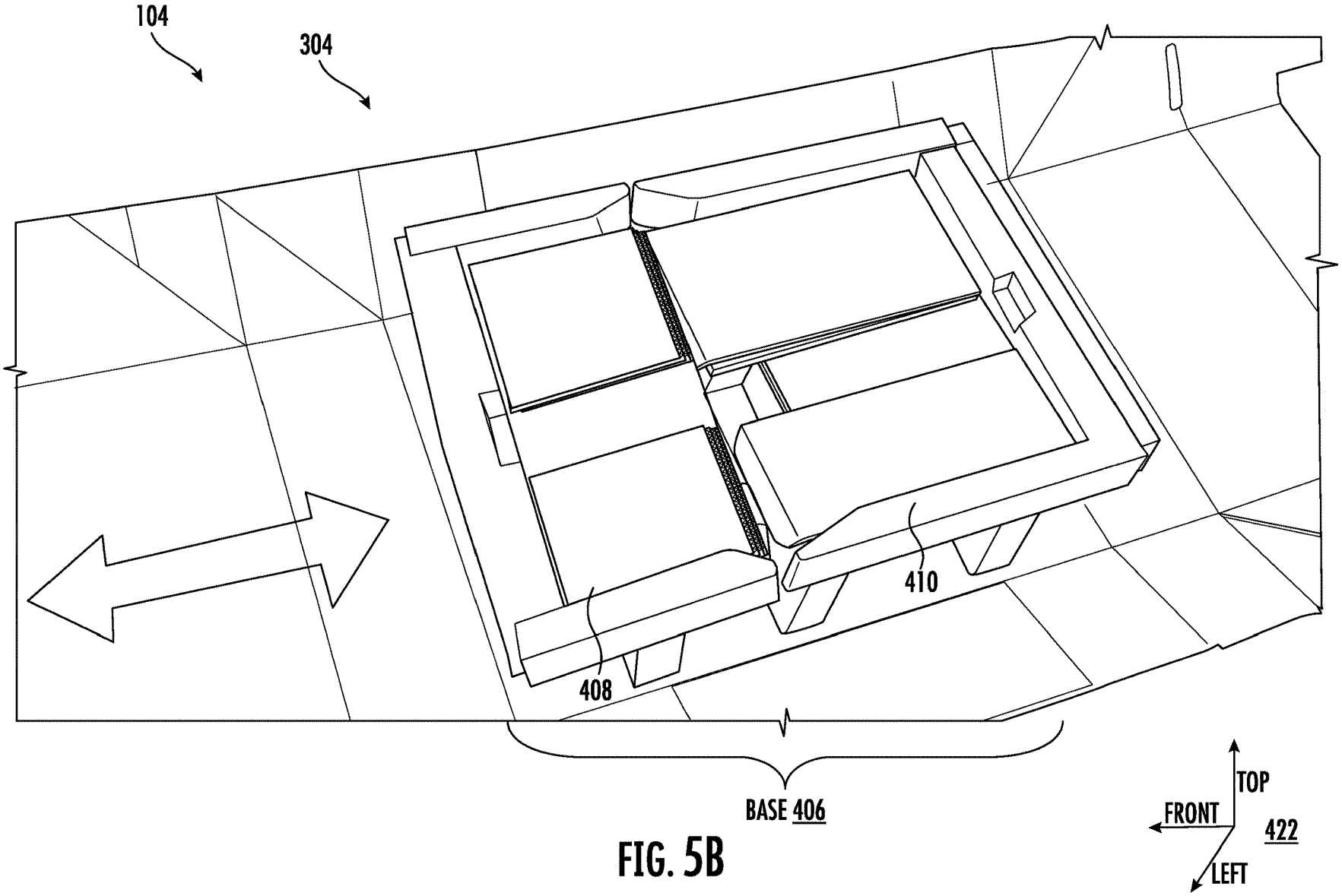
FIG. 5B illustrates features of the subject matter in accordance with one embodiment.

In some embodiments, when the removable portion 408 and the adhered portion 410 are set up to form the base 406, the channel 418*a* and the channel 418*b* align with each other (as shown in FIG. 4A and FIG. 5B).

The sidewalls 402 further include one or more locking slots 420*a*, 420*b*. The locking slots 420*a*, 420*b* facilitate one or more corresponding locking tabs (e.g., 518*a*, 518*b*, 518*c*) to be inserted into the locking slots 420*a*, 420*b* to keep the sidewalls 402 in a folded state.

FIG. 4B depicts the (second) folded state of the inner sleeve 304 according to one or more embodiments. The sidewalls 402 are folded to flatten the inner sleeve 304 to facilitate storage of the inner sleeve 304 without the machine 204 being inside the inner sleeve 304.

FIG. 5A depicts the device box 104 according to one or more embodiments. The device box 104 is shown in the unfolded state in FIG. 5A. Further, the removable portion 408 is shown separated from the adhered portion 410. All parts of the inner sleeve 304 are not labeled in FIG. 5A for brevity. In the unfolded state, the sidewalls 402 of the inner sleeve 304 provide a platform to roll the cabinet 202 over easily (compared to a carpet, rug, or any other such surface).

The device scaffold 416*b* of the adhered portion 410 includes a center relief 504. The center relief 504 is an opening through the adhered portion 410 that allows one or more items to be passed from the front to the back (or vice versa) and under the machine 204, when the machine 204 rests on the adhered portion 410. For example, a strap can be passed through the center relief 504 to secure the cabinet 202 to the machine 204 (described elsewhere herein).

The center relief 504 is aligned with the channel 418*b*. The center relief 504 includes a front aperture 506*a*. The front aperture 506*a* is formed by carving the front edges of the boundary 412*b*, and the device scaffold 416*b*. The front aperture 506*a* aligns with the channel 418*b* at the front of the device scaffold 416*b*. The center relief 504 further includes a rear aperture 506*b*. The rear aperture 506*b* is formed by carving the back edge of the boundary 412*b*. The rear aperture 506*b* aligns with the channel 418*b* at the back of the device scaffold 416*b*. The strap (or any other item) can be passed through the front aperture 506*a*, along the channel 418*b*, and retrieved at the rear aperture 506*b* (or vice versa).

The adhered portion 410 further includes a wheel guide 508. The wheel guide 508 helps align the cabinet 202 with the adhered portion 410 to help transfer the machine 204 from the adhered portion 410 to the cabinet 202 (or vice versa). In some embodiments, the wheel guide 508 is made of the same cushioning material as the boundaries (412*a*, 412*b*). Further, in some embodiments, the wheel guide 508 is part of the singular boundary 412*b*. Alternatively, the wheel guide 508 is a separate component that is affixed to the boundary 412*b* at a predetermined position. The wheel guide 508 is on the right side of the adhered portion 410 in FIG. 5A; however, the wheel guide 508 can be positioned differently (e.g., on the left side, along the center, etc.). In yet other embodiments, the inner sleeve 304 may include two wheel guides 508, one on the left and one on the right of the adhered portion 410.

The wheel guide 508 includes two guiding members 510*a* and 510*b*, and a back-stop 512. The guiding members 510*a* and 510*b* and the back-stop 512 form a passage 514, which guides a caster 206 of the cabinet 202 to be rolled in/out. In some embodiments, the width of the passage 514 is predetermined, and based on (e.g., equal to or substantially equal to) the width of the caster 206. In some embodiments, the height of the guiding members 510*a* and 510*b* is predetermined and based on (e.g., equal to, substantially equal to) the height of the caster 206. In some embodiments, each of the guiding members 510*a* and 510*b* has an angular front-end 520 to create a wider opening to the passage 514 to facilitate the caster 206 to be rolled into/out of the passage 514.

In some embodiments, the inner sleeve 304 further includes an anti-lock flap 516. The anti-lock flap 516 prevents locking tabs 518 from being trapped in the base 406 when the inner sleeve 304 is in one of the folded states.

FIG. 5B depicts the inner sleeve of the device box 104 in the unfolded state with the removable portion 408 still aligned with adhered portion 410 of the base 406.

Figure 6:
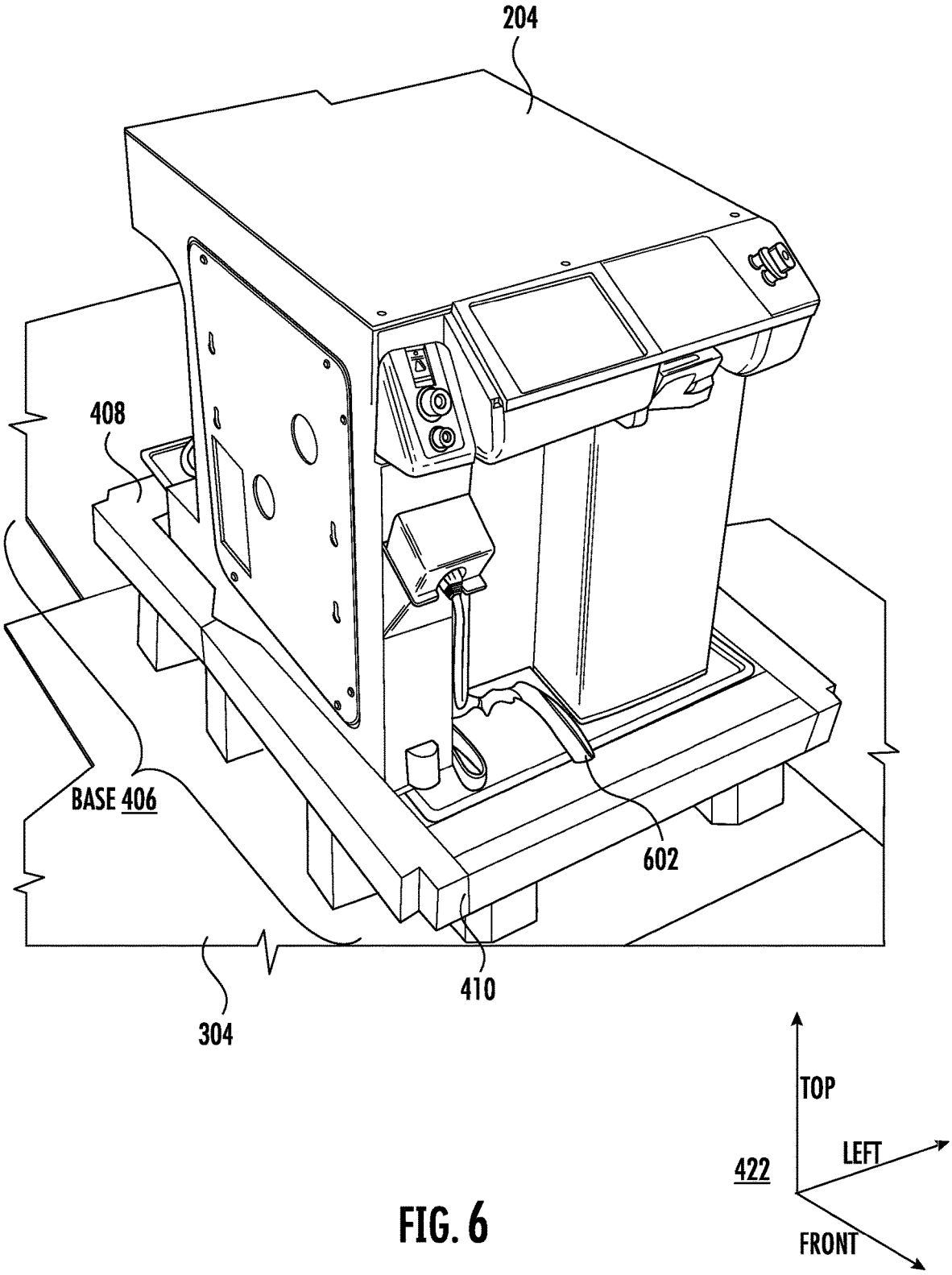
FIG. 6 illustrates features of the subject matter in accordance with one embodiment.

FIG. 6 depicts a machine 204 resting on the base 406 in an inner sleeve 304 according to one or more examples. The inner sleeve 304 is depicted in an unfolded state. The machine 204 is now to be removed from the inner sleeve 304 and housed in a cabinet 202 of the machine 204 to facilitate placement and use of the machine 204 by a patient, caregiver, healthcare professional, or other user. The inner sleeve 304 may also include a strap 602 to facilitate the removal and placement of the machine 204. In other embodiments, the strap 602 may be provided separately and not as contents of the inner sleeve 304. It should be noted that the view of FIG. 6 is in a different orientation than other views, as depicted by the direction map 422.

Figure 7:
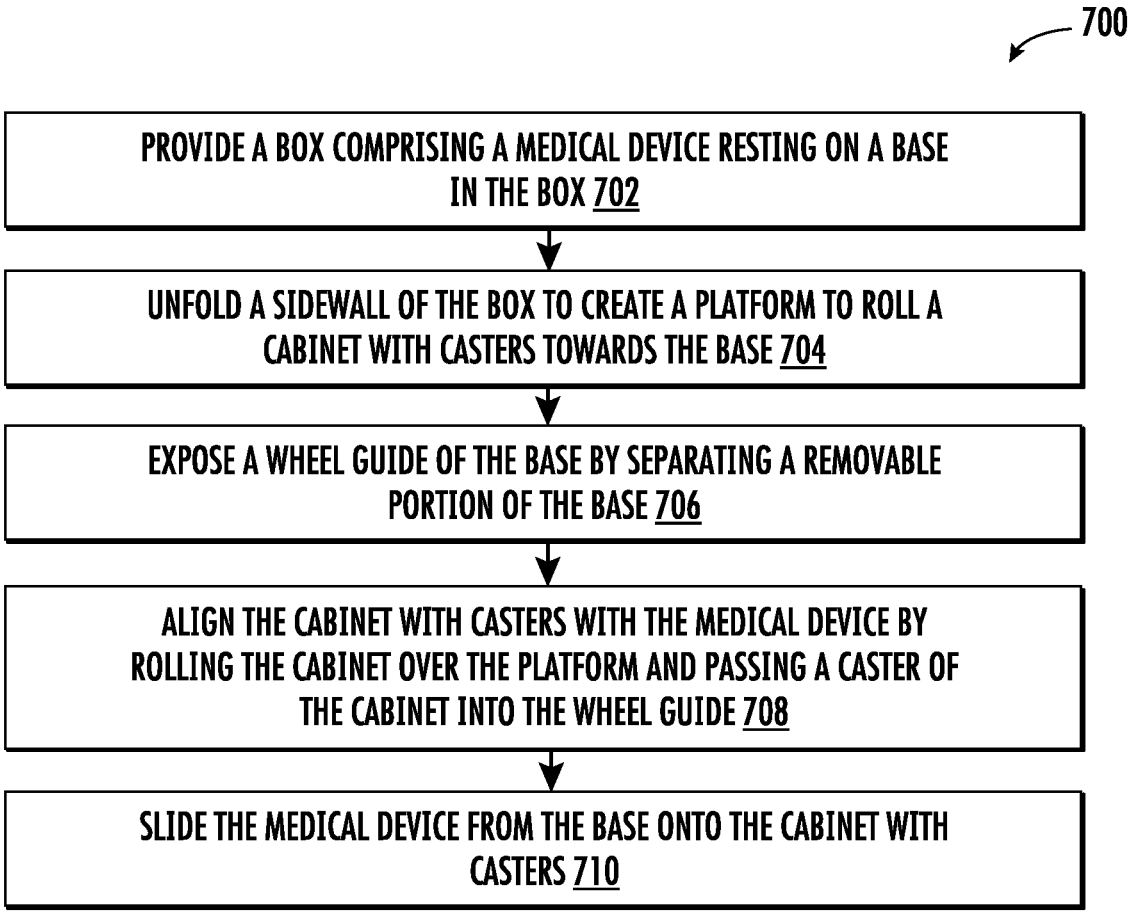
FIG. 7 illustrates a method in accordance with one embodiment.

FIG. 7 illustrates an example method 700 for unpacking a machine from a packaging system according to one or more embodiments. Although the example method 700 depicts a particular sequence of operations, the sequence may be altered without departing from the scope of the present disclosure. For example, some of the operations depicted may be performed in parallel or in a different sequence that does not materially affect the function of the method 700. In various examples, method 700 may be performed without certain operations depicted in FIG. 7. In other examples, different components of an example device, system, user, etc. that implements the method 700 may perform functions substantially simultaneously or in a specific sequence.

According to some examples, the method 700 includes providing packaging system 100, which includes a box comprising an object (such as a medical device (e.g., machine 204)) resting on a base 406 in the box at block 702. The box can be the inner sleeve 304. The packaging system 100 can be provided by shipping the device box 104 to the recipient, e.g., a patient, a care provider, etc., via a transporter, such as a carrier, courier, etc. The packaging system 100 further includes the cabinet 202. In some embodiments, the cabinet 202 is shipped as a separate shipment. Alternatively, or in addition, the cabinet 202 is provided in a separate box, such as the cabinet box 102. In other embodiments, the packaging system 100 can include one box that includes both, the machine 204 resting on the base 406, and the cabinet 202 (separate from the base 406).

According to some examples, the method 700 includes unfolding one or more sidewalls of the box to create a platform to roll the cabinet 202 with casters 206 towards the base 406 at block 704. In some embodiments, unfolding the sidewalls includes removing the inner sleeve 304 of the device box 104 from the outer sleeve 302. Further, the sidewalls are unfolded to lay flat on the ground surface, as shown in FIG. 6. In embodiments in which the machine 204 is surrounded with cushioning and/or protective material, such as bubble wrap, plastic film, etc., such material is removed.

Figure 8A:
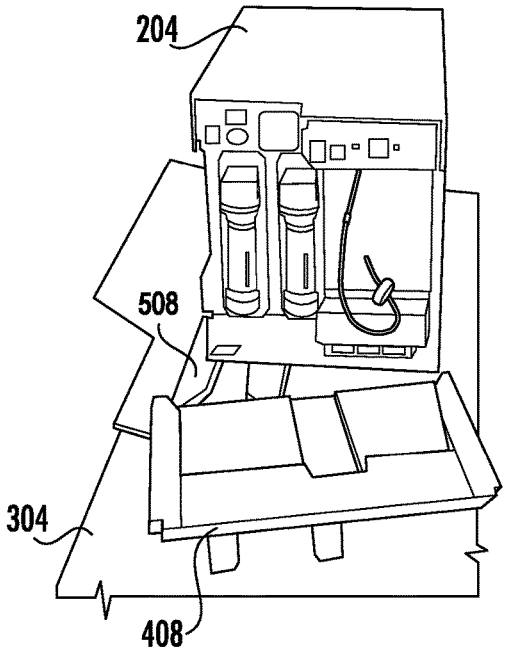
FIG. 8A illustrates features of the subject matter in accordance with one embodiment.
Figure 8B:
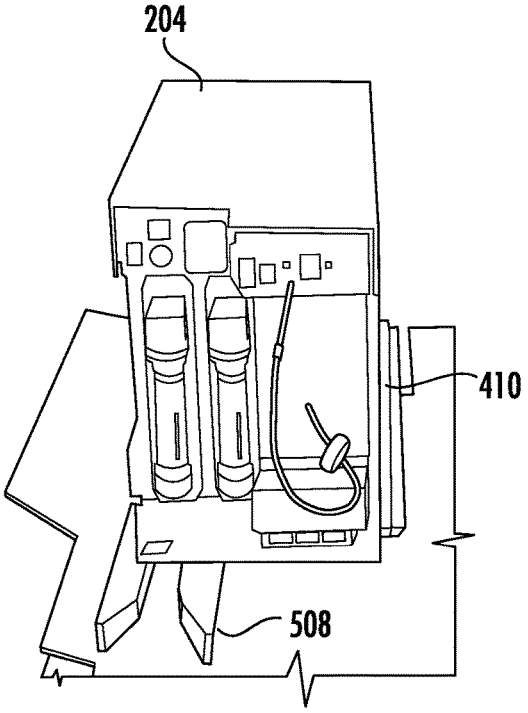
FIG. 8B illustrates features of the subject matter in accordance with one embodiment.

According to some examples, the method 700 includes exposing the wheel guide 508 of the base 406 by separating a removable portion 408 of the base 406 at block 706. FIG. 8A depicts the removable portion 408 being separated as described and FIG. 8B depicts the removable portion 408 removed and the wheel guide 508 exposed.

Figure 8C:
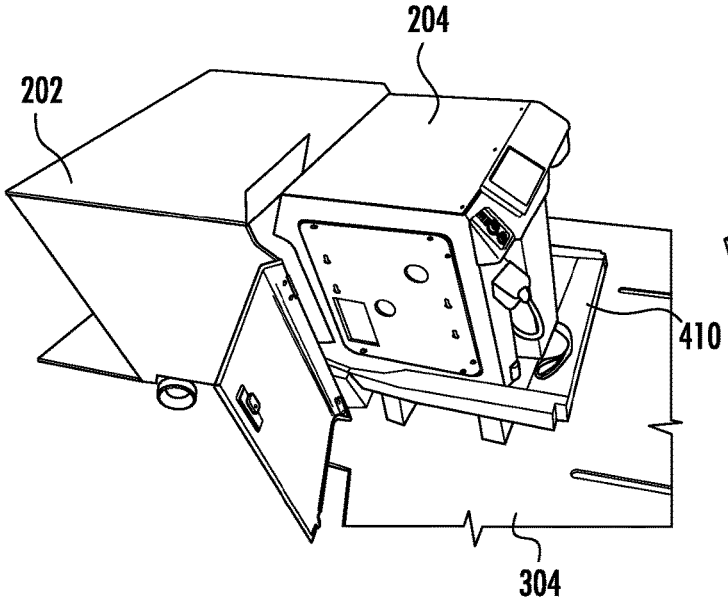
FIG. 8C illustrates features of the subject matter in accordance with one embodiment.

According to some examples, the method 700 includes aligning the cabinet 202 with casters 206 with the machine 204 by rolling the cabinet 202 over a platform created by the unfolded inner sleeve 304 and passing a caster 206 of the cabinet 202 into the wheel guide 508 at block 708. The cabinet 202 with casters 206 is moved over the cardboard inner sleeve 304 (flattened out) and against the cushioning platform provided by the boundary 412*b* of the adhered portion 410 of the base 406. In some embodiments, if the cabinet 202 has panels, such as a door, the panels are opened before the alignment. The raised device scaffold 416*b* allows the cabinet 202 to move into position underneath a part of the machine 204. See FIG. 8C. The raised device scaffold

416*b* because the wheel guide 508 facilitates a caster 206 of the cabinet 202 to align the cabinet 202 with the machine 204.

In some embodiments, the size and shape of the removable portion 408 is based on the center of gravity of the machine 204, such that the machine 204 remains supported by the adhered portion 410 of the base 406 so that the cabinet 202 can be positioned under the machine 204 when the removable portion 408 is separated.

Figure 8D:
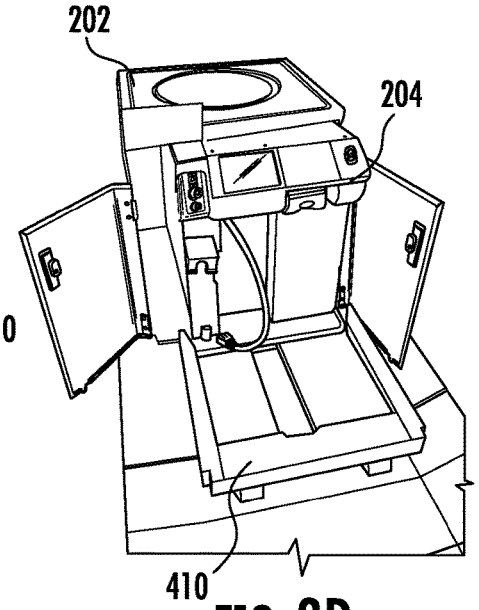
FIG. 8D illustrates features of the subject matter in accordance with one embodiment.

According to some examples, the method includes sliding the machine 204 from the adhered portion 410 of the base 406 onto the cabinet 202 at block 710. In some embodiments, the device scaffold 416*b* includes a friction-reducing material (e.g., Teflon® tape) at specific predetermined contact points where the machine 204 touches the device scaffold 416*b* to ease the sliding of the machine 204. See FIG. 8D.

Embodiments described herein facilitate a box (e.g., cardboard box, but other material can be used depending on cost and physical strength requirements) that is cut and shaped such that multiple flat panels (sidewalls) are connected at creases to allow the panels to bend and form the box. A raised platform (base 406) made of extruded foam, polystyrene foam, or other cushioning material is adhesively attached to at least a portion (e.g., bottom) of the cardboard box. The raised platform has a shape that matches the outer dimensions and shape of the machine 204 or module that is being shipped in the box. The platform comprises two separate pieces, with one of the pieces being adhered (adhered portion 410) to the box. In contrast, the other piece (removable portion 408) is not adhered to and is separable relative to the first piece. In use, the box is unfolded to create a flat platform. Then the second piece of the raised platform is removed, exposing an overhanging of the machine extending from the remaining portion (adhered portion 410) of the raised platform. Then, a cabinet with casters can be positioned next to the remaining raised platform so machine 204 can be guided into the cabinet. The box serves as an anchor position as the user stands on the box to hold it in place while maneuvering the cabinet 202 and/or machine 204.

In some embodiments, a strap anchoring and moving mechanism allows the raised platform (base 406) to attach to the cabinet 202 securely. Then the strap can be pulled to slide to the machine 204 from the raised platform directly into the cabinet. The strap 602 can be passed through a center relief 504 of the adhered portion 410 of the base 406 and pulled from the front of the machine 204 resting on adhered portion 410 of the base 406. The strap 602 can be pulled to align the cabinet 202 underneath the adhered portion 410 before sliding machine 204 into the cabinet 202 from the adhered portion 410.

In some embodiments, the height of the raised platform (base 406) keeps the machine 204 slightly above the inner floor of the cabinet 202 to facilitate sliding machine 204 from the adhered portion 410 into the cabinet 202.

Embodiments described herein provide a box (or first box) for shipping a first object in which the box is configured to facilitate alignment, support, and/or coupling (engagement, connection, etc.) of the first object with a second object. The second object may be shipped in a second box and may have its own alignment/connection/etc. features. In some embodiments, the second object may be shipped in the same box as the first object. In this manner, heavy components can be easily and efficiently unpacked, coupled, and put into operation by an individual, such as an inexperienced patient.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. In addition, while certain embodiments have been described and illustrated with certain features, it is envisioned that features of one embodiment may be used in combination with other embodiments. Moreover, the following claims are hereby incorporated into this Detailed Description by this reference, with each claim standing on its own as a separate embodiment of the present disclosure.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A packaging system for a medical device, comprising:
- a box that comprises:
  - an outer sleeve; and
  - an inner sleeve that is configured to contain the medical device, the inner sleeve comprising a base, the base comprising:
    - a removable portion that is separable from the inner sleeve; and
    - an adhered portion that is secured to the base and comprises a wheel guide to align a cabinet, into which the medical device is unloaded from the adhered portion of the base;
- wherein the removable portion is configured to be positioned next to the adhered portion, within the inner sleeve, to support a weight of the medical device; and
- wherein the outer sleeve is shaped to fit over the inner sleeve and contain the inner sleeve within the outer sleeve.

2. The packaging system of claim 1, wherein
- the adhered portion of the base further comprises a center relief; and
- a strap is passed through the center relief to align and secure the cabinet with the medical device while the medical device is on the adhered portion.

3. The packaging system of claim 1, wherein the inner sleeve comprises at least two sidewalls that unfold and flatten to facilitate rolling the cabinet for alignment with the adhered portion.

4. The packaging system of claim 3, wherein the outer sleeve is a five-sided box;

the inner sleeve comprises four sides that are formed, at least in part, by the at least two sidewalls;

the outer sleeve covers a top and the four sides of the inner sleeve when the inner sleeve is within the outer sleeve; and the outer sleeve and the inner sleeve are configured for being rigidly attached together to secure the medical device within the packaging system.

5. The packaging system of claim 1, wherein the adhered portion comprises a friction-reducing surface to facilitate sliding the medical device onto the cabinet.

6. The packaging system of claim 1, wherein the removable portion of the base aligns with the wheel guide during the transportation of the medical device.

7. The packaging system of claim 1, wherein the box is manufactured using a corrugated material.

8. The packaging system of claim 1, wherein the base is manufactured using cardboard and polystyrene foam.

9. The packaging system of claim 1, wherein:

the removable portion comprises a first boundary that comprises a cushioning material; and the adhered portion comprises a second boundary that comprises the cushioning material.

10. The packaging system of claim 9, wherein the cushioning material comprises extruded foam, polystyrene foam, air pillows, thermoform, or paper.

11. The packaging system of claim 9, wherein the first boundary is a first single piece of the cushioning material, which comprises a first cavity, in which a device scaffold is positioned, the device scaffold being configured to support a portion of the weight of the medical device.

12. The packaging system of claim 11, wherein the second boundary is a second single piece of the cushioning material, which comprises a second cavity, in which a further device scaffold is positioned, the further device scaffold being configured to support a further portion of the weight of the medical device.

13. The packaging system of claim 12, wherein:

the device scaffold of the removable portion comprises a first channel that extends from a front to a back along a center of the device scaffold; and the further device scaffold of the adhered portion comprises a second channel that extends from the front to the back along a center of the further device scaffold.

* * * * *